US005752700A

United States Patent [19]

Delzotti

[11] Patent Number: 5,752,700

[45] Date of Patent: May 19, 1998

[54] PAGEANT GAME

[76] Inventor: Tina C. Delzotti, 4 High Bluff Way, Ormond Beach, Fla. 32174

[21] Appl. No.: 874,068

[22] Filed: Jun. 12, 1997

[51] Int. Cl.[6] ..... A63F 3/00

[52] U.S. Cl. ..... 273/243

[58] Field of Search ..... 273/242, 243, 273/248, 249

[56] References Cited

U.S. PATENT DOCUMENTS

| | | | |
|---|---|---|---|
| 4,065,131 | 12/1977 | Martin | 273/243 |
| 4,124,214 | 11/1978 | Pavis | 273/249 |
| 4,279,422 | 7/1981 | Shaw | 273/243 X |
| 4,368,889 | 1/1983 | Reker, Jr. . | |
| 4,497,490 | 2/1985 | Rogers, Jr. . | |
| 4,787,639 | 11/1988 | Ross | 273/249 |
| 4,993,717 | 2/1991 | Fiske . | |
| 5,052,692 | 10/1991 | Gustafson | 273/249 |
| 5,104,127 | 4/1992 | Whitney | 273/243 |
| 5,476,263 | 12/1995 | Romaniello . | |

*Primary Examiner*—William E. Stoll
*Attorney, Agent, or Firm*—Paul S. Rooy

[57] ABSTRACT

A pageant game and method of play. The pageant game comprises a game board, contestant pieces, chance device, vote tokens, bad marks, judge name cards, judge vote tokens, evening gown cards, swimsuit cards, talent cards and interview cards. The game board is marked with a game course, start circles, a vote tokens repository, a bad marks repository, judge name squares, a judge vote token repository associated with each judge name square, and card repositories. In the preferred embodiment, the game board was marked with an evening gown cards repository, a swimsuit cards repository, a talent cards repository, and an interview cards repository. The method of play includes the steps of determining an order of play using the chance device, advancing contestant pieces over the game course as determined by the chance device, following instructions on tiles contained within the game course, including drawing cards and following card instructions, and accumulating vote tokens, judge vote tokens, and bad mark tokens. A game may consist of a single round or multiple rounds. At the conclusion of play, the vote tokens, judge vote tokens and bad mark tokens are tallied for each contestant piece, and for each contestant piece twice the bad mark token count is subtracted from the combined vote token and judge vote token count, thus determining a game score for each contestant piece. The contestant piece having the highest game score is declared the winner.

12 Claims, 6 Drawing Sheets

FIG 2
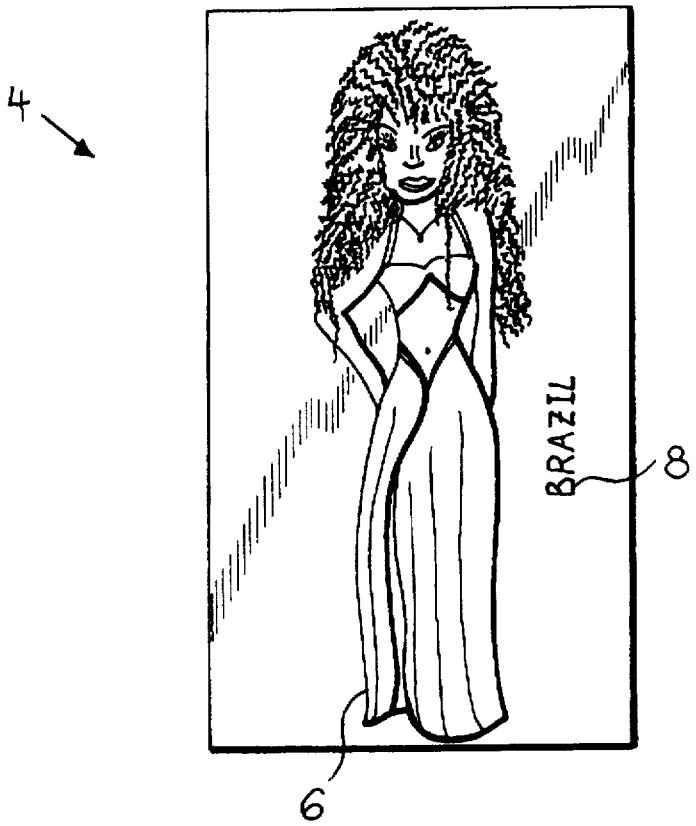
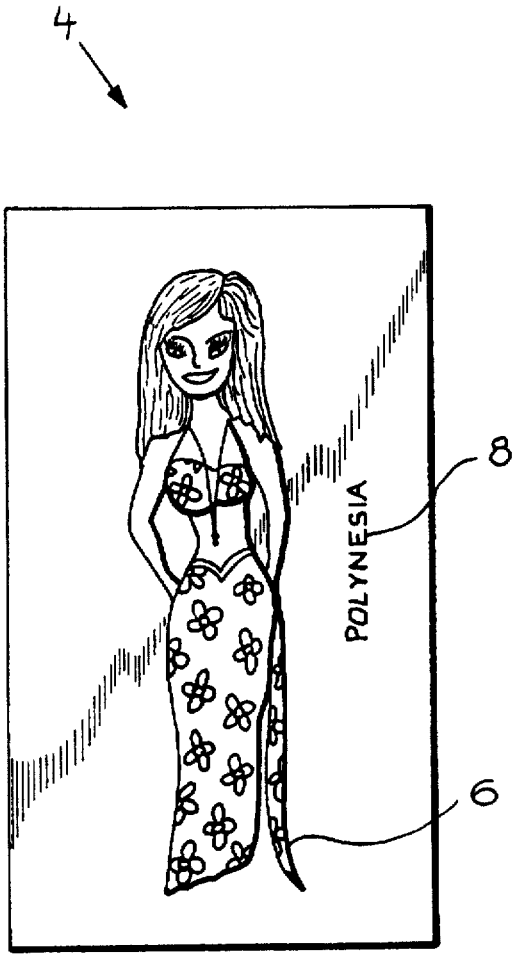
FIG 3

FIG 4
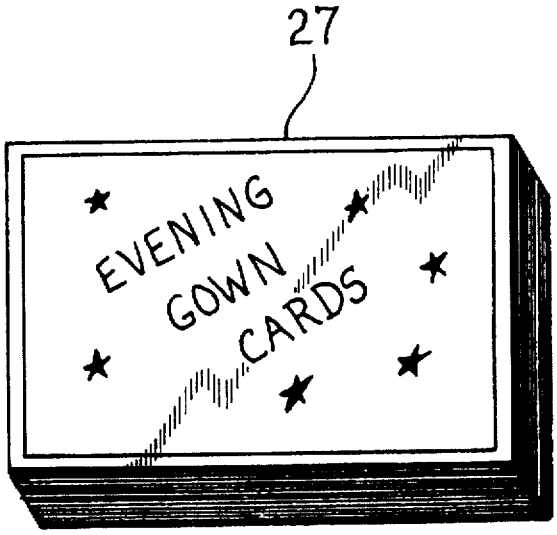
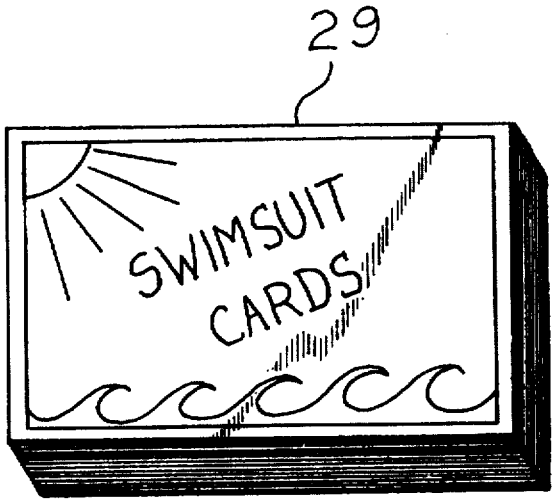
FIG 5

FIG 6
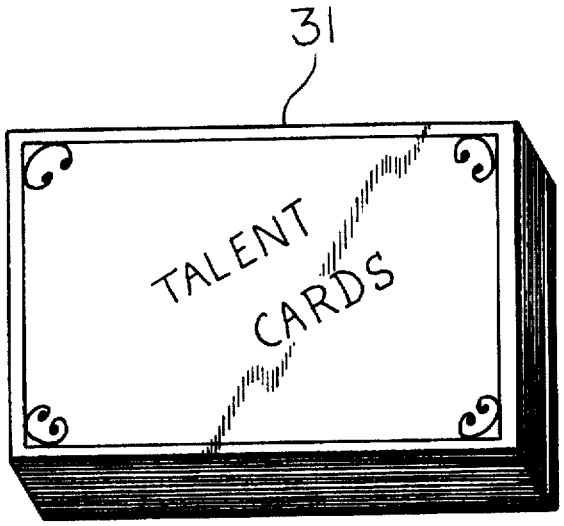
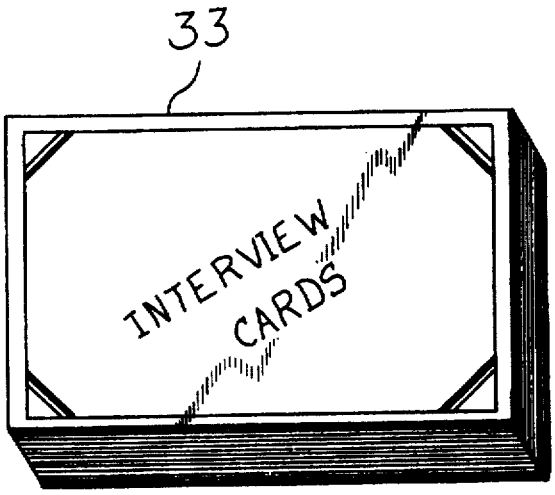
FIG 7

FIG 8
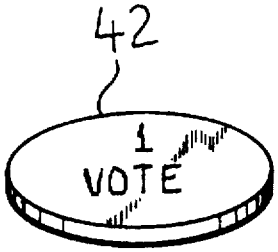
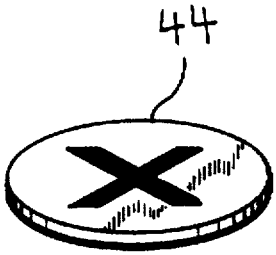
FIG 9
FIG 10
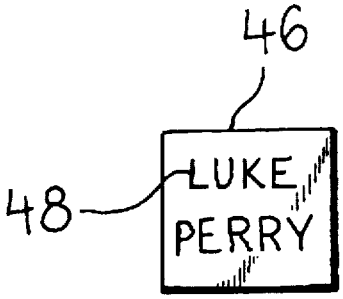
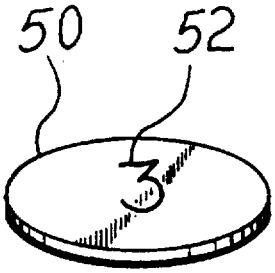
FIG 11

FIG 12
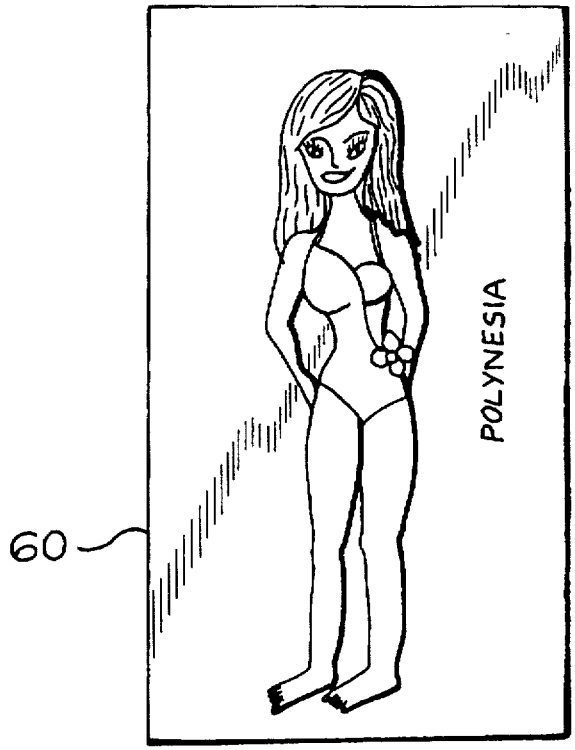
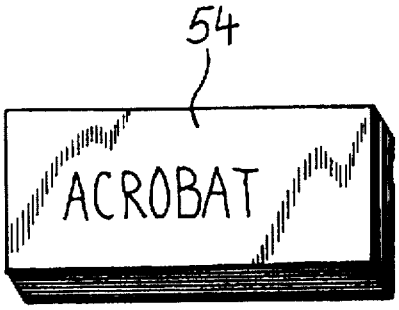
FIG 13

PAGEANT GAME

BACKGROUND OF THE INVENTION

Field of the Invention

This invention relates to board games, and in particular to a pageant board game.

Background of the Invention

Beauty pageants have been major social events all during recorded human history. These events have evolved to include not only a contest decided on the physical beauty of the contestants, but events which compare the poise, articulateness, and talent of the participants.

Existing Designs

Board games can provide useful simulations of actual events, and permit game players to hone their skills without actually participating in an actual competition. Games simulating sports events have been developed featuring a number of experiences. For example, Romaniello was granted U.S. Pat. No. 5,476,263 for a table game which simulated the development of a sports championship. Reker was granted U.S. Pat. No. 4,368,889 which simulated school experiences. U.S. Pat. No. 4,993,717 was granted Fiske for a board game directed towards young girls, and was intended to simulate the application of cosmetic make-up. None of these games, however, were directed towards the simulation of a modern beauty pageant.

SUMMARY OF THE INVENTION

Accordingly, it is an object of the present invention to provide a pageant game which simulates a modern beauty pageant. Design features allowing this object to be accomplished include a game board having a course, vote tokens repository and bad marks repository, vote tokens, bad mark tokens, a die, and judges. Advantages associated with the accomplishment of this object include familiarizing the players with the way modern beauty pageants are conducted, and player amusement.

It is another object of the present invention to provide a pageant game which simulates the evening gown phase of a beauty pageant. Design features allowing this object to be accomplished include evening gown cards and an evening gown card repository. Benefits associated with the accomplishment of this object include familiarizing the players with the way the evening gown phase of a beauty pageant is conducted, and player amusement.

It is another object of the present invention to provide a pageant game which simulates the swimsuit phase of a beauty pageant. Design features allowing this object to be accomplished include swimsuit overlays, swimsuit cards, and a swimsuit card repository. Benefits associated with the accomplishment of this object include familiarizing the players with the way the swimsuit phase of a beauty pageant is conducted, and player amusement.

It is still another object of the present invention to provide a pageant game which simulates the talent phase of a beauty pageant. Design features allowing this object to be accomplished include skill cards, talent cards, and a talent card repository. Benefits associated with the accomplishment of this object include familiarizing the players with the way the talent phase of a beauty pageant is conducted, and player amusement.

It is another object of the present invention to provide a pageant game which simulates the interview phase of a beauty pageant. Design features allowing this object to be accomplished include interview cards and an interview card repository. Benefits associated with the accomplishment of this object include familiarizing the players with the way the interview phase of a beauty pageant is conducted, and player amusement.

It is yet another object of this invention to provide a pageant game which is affordable. Design features allowing this object to be achieved include the use of components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Six sheets of drawings are provided. Sheet one contains FIG. 1. Sheet two contains FIGS. 2 and 3. Sheet three contains FIGS. 4 and 5. Sheet four contains FIGS. 6 and 7. Sheet five contains FIGS. 8, 9, 10 and 11. Sheet six contains FIGS. 12, 13 and 14.

FIG. 2 is a front view of a contestant piece.

FIG. 3 is a front view of another contestant piece.

FIG. 4 is a top isometric view of a stack of evening gown cards.

FIG. 5 is a top isometric view of a stack of swimsuit cards.

FIG. 6 is a top isometric view of a stack of talent cards.

FIG. 7 is a top isometric view of a stack of interview cards.

FIG. 8 is a side isometric view of a vote token.

FIG. 9 is a side isometric view of a bad mark token.

FIG. 10 is a top view of a judge name card.

FIG. 11 is a side isometric view of a judge vote token.

FIG. 12 is a front view of a swimsuit overlay.

FIG. 13 is a top isometric view of a stack of skill cards.

DETAILED DESCRIPTION OF THE PREFERRED EMBODIMENT

Game Apparatus

Figure 1:
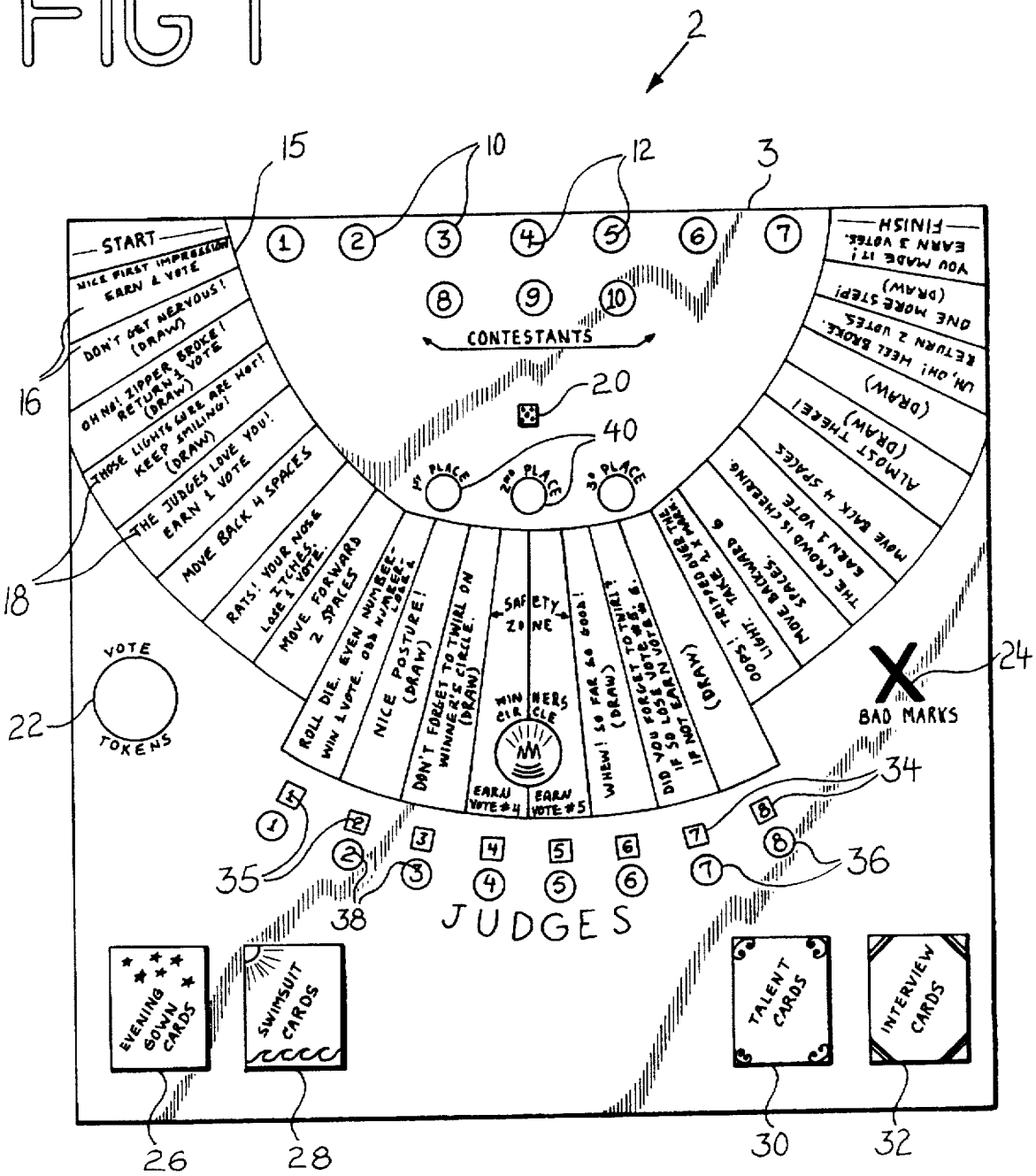
FIG. 1 is a plan view of a pageant game.

Pageant game 2 comprises the following elements: game board 3, contestant pieces 4, die 20, evening gown cards 27, swimsuit cards 29, talent cards 31, interview cards 33, vote tokens 42, bad mark tokens 44, judge name cards 46 and judge vote tokens 50.

As may be observed in FIG. 1, game board 3 bears indicia, including game course 15 made up of tiles 16 bearing tile indicia 18. The first tile 16 in game course 15 is marked "START" and the last tile 16 in game course 15 is marked "FINISH". Intermediate tiles 16 contain instructions such as "MOVE BACK 4 SPACES", "THE CROWD IS CHEERING. EARN 1 VOTE", etc. One or more tiles 16 may be marked "SAFETY ZONE". If a contestant piece 4 is disposed on a tile 16 thus marked, that contestant piece 4 is immune from being disqualified, or from being forced to surrender its vote tokens 42 or 50. During play, contestants pieces 4 move along game course 15 as determined by die 20, then follow the instructions on the tile 16 landed upon.

In the preferred embodiment, game course 15 bore the following tile indicia 18 on consecutive tiles 16:

START

NICE FIRST IMPRESSION! EARN 1 VOTE

DON'T GET NERVOUS! (DRAW)

ON NO! ZIPPER BROKE! RETURN 1 VOTE. (DRAW)

THOSE LIGHTS SURE ARE HOT! KEEP SMILING! (DRAW)

THE JUDGES LOVE YOU! EARN 1 VOTE

MOVE BACK 4 SPACES

RATS! YOUR NOSE ITCHES. LOSE 1 VOTE

MOVE FORWARD 2 SPACES

ROLL DIE. EVEN NUMBER WIN 1 VOTE. ODD NUMBER LOSE 1 VOTE

NICE POSTURE! (DRAW)

DON'T FORGET TO TWIRL ON THE WINNERS CIRCLE. (DRAW)

EARN VOTE #4.

EARN VOTE #5

SAFETY ZONE WINNERS CIRCLE [Spread across the previous two tiles 16]

WHEW! SO FAR SO GOOD! (DRAW)

DID YOU FORGET TO TWIRL? IF SO LOSE VOTE #5. IF NOT EARN VOTE #6 (DRAW)

OOPS! TRIPPED OVER THE LIGHT! TAKE 1X MARK

MOVE BACKWARDS 6 SPACES

THE CROWD IS CHEERING. EARN 1 VOTE

MOVE BACK 4 SPACES

ALMOST THERE! (DRAW) (DRAW)

UH, OH! HEEL BROKE. RETURN 2 VOTES

ONE MORE STEP! (DRAW)

YOU MADE IT! EARN 3 VOTES FINISH

Game board 3 is further marked with start circles 10 bearing start circle indicia 12, and winner position circles 40. Start circles 10 are marked with ascending numbers (from 1 to 10 in the preferred embodiment). Winner position circles 40 are marked in winning descending order ("FIRST PLACE", "SECOND PLACE" and "THIRD PLACE" in the preferred embodiment).

Game board 3 is also marked with vote tokens repository 22 and bad mark tokens repository 24. During play, contestants draw vote tokens 42 and bad mark tokens 44 from vote tokens repository 22 and bad marks repository 24 respectively, as instructed by tile indicia 18 and/or evening gown cards 27, swimsuit cards 29, talent cards 31, or interview cards 33.

Game board 3 is also marked with judge name squares 34. Each judge name square 34 has an associated judge vote token repositories 36. Judge name squares 34 bear judge name square indicia 35, and judge vote token repositories 36 bear judge vote token repository indicia 38. During game setup, a judge name card 46 bearing judge name card indicia 48 identifying the judge is placed on each judge name square 34. Judge vote tokens 50 bearing judge vote token indicia 52 identifying the appropriate judge are then placed on the judge vote token repository 36 adjacent each judge name square 34. During play, contestants draw judge vote tokens 50 from judge vote token repositories 36, as instructed by tile indicia 18 and/or evening gown cards 27, swimsuit cards 29, talent cards 31, or interview cards 33.

Game board 3 is further marked with evening gown cards repository 26, swimsuit cards repository 28, talent cards repository 30 and interview cards repository 32. During game setup, a stack of evening gown cards 27 is placed on evening gown cards repository 26, a stack of swimsuit cards 29 is placed on swimsuit cards repository 28, a stack of talent cards 31 is placed on talent cards repository 30, and a stack of interview cards 33 is placed on interview cards repository 32. FIGS. 4–7 depict stacks of evening gown cards 27, swimsuit cards 29, talent cards 31, and interview cards 33 respectively.

A game may be comprised of four rounds: an evening gown round, a swimsuit round, a talent round, and an interview round. During play, contestants draw cards 27, 29, 31 and 33 as instructed by tile indicia 18. During each round, only cards appropriate to that round are drawn: during the evening gown round, only evening gown cards 27 are drawn, during the swimsuit round only swimsuit cards 29 are drawn, etc.

FIGS. 2 and 3 depict typical contestant pieces 4. Contestant pieces 4 bear model 6 and contestant piece indicia 8 which identifies a country of origin of model 6. For example, FIG. 2 depicts contestant piece 4 showing model 6 from Brazil, and contestant piece indicia 8 "BRAZIL". In the preferred embodiment, contestant pieces 4 bore contestant piece indicia 8 indicating models 6 origins Africa, Alaska, Argentina, Australia, Bahamas, Belgium, Brazil, Canada, China, Egypt, England, Finland, France, Germany, Greece, Haiti, Hawaii, India, Indonesia, Iran, Ireland, Israel, Italy, Jamaica, Japan, Poland, Polynesia, Mexico, New Zealand, Norway, Poland, Russia, Scotland, Sicily, Singapore, Spain, Sweden, Switzerland, Thailand, Turkey, USA, and Yugoslavia.

FIGS. 4–7 depict stacks of evening gown cards 27, swimsuit cards 29, talent cards 31 and interview cards 33 respectively.

In the preferred embodiment, evening gown cards 27 included the following instructions:

CONTESTANT 6, 7 OR 8 PICKED ARGUMENT WITH CONTESTANT #3. ROLL THE DIE TO FIND OUT. LOWEST ROLLER GIVES 1 VOTE TO #3.

CONTESTANT #2'S GOWN VERY FASHIONABLE. SHE EARNS 2 VOTES.

JUDGES #1 & 8 ARE MESMERIZED BY THE CONTESTANT STANDING ON OR CLOSEST TO THE WINNERS CIRCLE. SHE, OR IN CASE OF A TIE, BOTH WIN #1 & #8 VOTES.

YOUR GOWN ISN'T VERY COMFORTABLE. IT IS MAKING YOU WALK FUNNY. JUDGE #4 NOTICES. RETURN HIS VOTE.

ALL BLONDES AND RED-HEADS GET 1 VOTE.

IF ANOTHER CONTESTANT IS STANDING ON THE SAME SPACE AS YOU, SHE GIVES YOU 1 VOTE.

IF YOUR GOWN IS RED, BLUE, OR YELLOW YOU EARN 1 VOTE FOR CHOOSING A PRIMARY COLOR.

IF YOUR GOWN IS THE SAME COLOR AS THE CONTESTANT BOX #, YOU EARN 1 VOTE.

MOVE FORWARD 2 SPACES.

JENNY TRIPPED! RETURN 1 OF HER VOTES.

MYRA'S GOWN IS BLINDING JUDGE #4. SHE RETURNS 1 VOTE.

EXTRA CREDIT—TAKE ANY 1 VOTE FROM THE JUDGES.

CONTESTANT #5 SNUBBED YOU. TAKE 1 OF HER VOTES. YOU CHOOSE.

PAULA PAID TOO MUCH MONEY FOR HER GOWN, BUT THE JUDGES LOVE IT. SHE EARNS 2 VOTES.

YOUR TWIRL WAS VERY NICE. JUDGE #5 WAS ESPECIALLY IMPRESSED. EARN #5'S VOTE.

YOUR SMILE IS DAZZLING AND YOU HAVE SPECIAL QUALITIES THAT GO BEYOND BEAUTY. EVERYONE NOTICES. EARN 2 VOTES.

YOUR GOWN IS BEAUTIFUL BUT JUDGE #3 HATES THAT COLOR. RETURN HIS VOTE.

PAULA WAS GOSSIPING ABOUT YOU TO THE OTHER GIRLS. BAD GIRL. TAKE 1 OF HER VOTES. YOU CHOOSE.

SOMEONE GIGGLED DURING YOUR FIRST ROUND WALK. ALL PLAYERS ROLL DIE. LOWEST ROLL IS THE GIGGLER. SHE LOSES 1 VOTE.

MOVE BACK 4 SPACES. IF UNABLE, MOVE FORWARD 1 SPACE.

UH! OH! YOU FORGOT TO SMILE. TAKE 1 BAD MARK.

JENNY LOOKS WONDERFUL. SHE EARNS 3 VOTES.

SO WHAT DO YOU THINK ABOUT MYRA? ISN'T SHE SWEET? THE JUDGES THINK SO TOO. SHE EARNS 4 VOTE TOKENS.

RETURN ONE BAD MARK IF YOU HAVE IT. (EVENING GOWN ROUND ONLY)

MOVE BACK 1 SPACE.

PSST! THIS IS A SECRET. DON'T TELL ANYONE. BUT JUDGE #6 LIKES YOU. SAVE THIS CARD AND EARN HIS VOTE WHEN NEEDED, OR TAKE VOTE #6 NOW AND DISCARD.

In the preferred embodiment, swimsuit cards 29 included the following instructions:

JUST IGNORE CONTESTANT #3'S REMARK. TAKE 1 OF HER VOTES.

IF YOU ARE WEARING A SWIMSUIT THE SAME COLOR AS YOUR SHIRT EARN 1 VOTE.

GREAT STYLE! EARN 1 VOTE FROM THE TOKEN BOX.

CONTESTANTS 1, 5, & 7 CHOOSE GREAT-LOOKING SWIMSUITS. THEY EACH EARN ONE VOTE.

PAULA'S LEGS LOOK A LITTLE HAIRY! SHE EARNS 1 BAD MARK

IF YOUR SWIMSUIT IS RED, BLUE OR YELLOW, YOU LOSE 1 VOTE. JUDGE #8 DOESN'T LIKE THEM.

JENNY HAS SUCH A GRACEFUL WALK. SHE EARNS JUDGE #8'S VOTE.

CONTESTANT #9'S SWIMSUIT IS STUNNING. SHE EARNS 2 VOTES FROM THE TOKEN BOX.

YOUR SUIT IS VERY MODEST AND CLASSY. EARN 1 VOTE AND RETURN 1 BAD MARK.

MYRA LOOKS SO CUTE! JUDGE #6 DECIDES TO GIVE HER YOUR VOTE INSTEAD.

ROLL DIE. ODD NUMBER LOSE 1 VOTE. EVEN NUMBER EARN 1 VOTE.

DID YOU SWIM IN THAT SUIT BEFORE YOU WORE IT? EARN 1 BAD MARK.

TAKE 1 STEP FORWARD.

GO TO WINNERS' CIRCLE. ROLL THE DIE & WIN THE JUDGE VOTE NUMBER OF THE DIE THAT YOU ROLLED.

MYRA'S SUIT IS PERFECTLY FITTED TO HER SHAPE. SHE WINS 2 VOTES.

ALL CONTESTANTS WEARING 1 PIECE SWIMSUITS EARN 1 VOTE.

TAKE 3 STEPS BACKWARDS.

PAULA ATTRACTS THE ATTENTION OF JUDGE #2. SHE EARNS HIS VOTE.

JUDGE #1 LOVES THE STYLE OF YOUR SWIMSUIT. EARN HIS VOTE. JUDGE #3 THINKS CONTESTANT #7'S SUIT LOOKS TERRIBLE. SHE RETURNS HIS VOTE.

CONTESTANTS #2 & #8 EARN 1 VOTE EACH FOR POLITENESS DURING THE CONTEST.

JENNY'S SWIMSUIT IS TOO TIGHT. RETURN JUDGE #6 VOTE IF SHE HAS IT.

OH! NO! SOME PRANKSTER IN THE BACK OF THE AUDIENCE JUST BOO'D YOU! RETURN 2 VOTES.

DON'T FORGET TO SMILE! WHEN YOU FEEL HAPPY, YOU LOOK BEAUTIFUL!

THOSE SHOES MAKE YOUR LEGS LOOK LONG. EARN 1 VOTE.

IF YOUR SWIMSUIT MATCHES THE COLOR OF CONTESTANT #1'S SHIRT, EARN ONE VOTE.

In the preferred embodiment, talent cards 31 included the following instructions:

THE POETESS & OPERAS SINGER IMPRESS THE CROWD. THEY RECEIVE 2 VOTES EACH.

IF YOU ARE PLAYING AN INSTRUMENT YOU MISSED A NOTE. RETURN 1 VOTE.

PSST! THIS IS A SECRET. DON'T TELL ANYONE. JUDGE #1 LIKES YOU. SAVE THIS CARD AND STEAL HIS VOTE FROM ANOTHER CONTESTANT WHEN NEEDED.

ALL SINGERS ROLL THE DIE. HIGHEST ROLLER WINS JUDGE #1'S VOTE.

CONTESTANTS #3, #9 AND #10 MUST ROLL THE DIE. HIGHEST ROLL IS THE MOST TALENTED AND WINS JUDGE #1'S VOTE.

ALTHOUGH PAULA ISN'T VERY TALENTED, SHE REPRESENTS HERSELF SUPERBLY. SHE WINS 2 VOTES.

ALL INSTRUMENT PLAYERS EARN 1 VOTE EACH.

THAT WAS VERY NICE OF YOU TO HELP THE OTHER CONTESTANTS WITH THEIR TALENT PREPARATION. EARN 1 VOTE AND RETURN 1 BAD MARK

JENNY IS SUPER-TALENTED. SHE EARNS VOTES FROM JUDGES #1 & #6.

CONTESTANT #1 IS VERY NERVOUS. SHE RETURNS 1 VOTE.

THE PIANO NEEDS TUNING. IF YOU ARE THE PIANO PLAYER, LOSE 1 VOTE.

OOPS! YOU GOOFED ON YOUR PRESENTATION. RETURN JUDGE #5'S VOTE. (HE NOTICES!)

CONTESTANTS #1 AND #10 EARN 1 VOTE EACH FOR PROPER BEHAVIOR DURING THE CONTEST.

IF YOU ARE PLAYING AN INSTRUMENT OR SINGING, EARN 1 VOTE FROM JUDGE #2. HE THINKS YOU'RE DOING GREAT!

ALL DANCERS GET 1 VOTE.

IF YOU ARE THE JUGGLER, YOU DROPPED A PIN. LOSE 1 VOTE.

BONUS CREDIT YOU GET 2 VOTES.

IF YOU ARE A DANCER, ROLL THE DIE. ODD NUMBER YOU FALL & LOSE 1 VOTE. EVEN NUMBER EARN 1 VOTE.

IF YOU ARE THE BATON TWIRLER, YOU'VE IMPRESSED JUDGE #6. EARN HIS VOTE.

PAULA IMPRESSES THE JUDGE CLOSEST TO YOU. SHE GETS HIS VOTE.

MYRA IS A GREAT ACROBAT. SHE EARNS 3 VOTES.

PAULA OBVIOUSLY SPENT HER SINGING LESSONS MONEY ON HER DRESS. SHE LOSES 1 VOTE.

IF YOUR TALENT IS TWIRLING THE BATON, YOU'VE JUST DROPPED IT. EARN 1 BAD MARK.

MOVE FORWARD 1 SPACE.

ROLL THE DIE. RETURN 1 VOTE FOR ODD NUMBER. EARN 1 VOTE FOR EVEN NUMBER.

CLOSE YOUR EYES AND GUESS THE PERSON TO YOUR RIGHT'S EYE COLOR. GUESS CORRECT. EARN 1 VOTE. GUESS WRONG. LOSE 1 VOTE TO HER.

In the preferred embodiment, interview cards 33 included the following instructions:

ROLL THE DIE. EVEN NUMBER GETS ONE VOTE—ODD NUMBER LOSES JUDGE #3'S VOTE.

WHILE YOU WERE DOING YOUR INTERVIEW, SOMEONE SNEEZED IN THE BACKGROUND. EACH GIRL ROLL THE DIE. LOWEST NUMBER IS THE SNEEZER. TAKE 1 VOTE FROM HER.

CONTESTANTS 2, 4, & 6 MUST ROLL THE DIE. HIGHEST ROLL IMPRESSES JUDGE #8 AND WINS HIS VOTE.

JENNY SOUNDS VERY INTELLIGENT. SHE EARNS JUDGE #3'S VOTE.

JUDGE #6 LIKES YOUR ACCENT. TAKE OR STEAL HIS VOTE FROM ANYONE OR FROM THE JUDGE.

ALL BRUNETTES GET 1 VOTE.

ALL ODD NUMBERED CONTESTANTS EARN 1 VOTE.

JENNY'S ANSWER TO THE ENVIRONMENTAL QUESTION REALLY IMPRESSED JUDGE #1. SHE EARNS HIS VOTE.

WOW! WHAT BEAUTIFUL HAIR YOU HAVE! JUDGE #8 LOVES IT. EARN HIS VOTE.

INTERVIEW QUESTION: IF YOU COULD RID THE WORLD OF ONLY ONE THING, WHAT WOULD IT BE & WHY? (EARN 1 VOTE FOR ANSWER.)

ALL THE JUDGES THINK EITHER MYRA, PAULA, OR JENNY CHEATED AND KNEW THE INTERVIEW QUESTION BEFOREHAND. ROLL THE DIE TO FIND OUT. LOWEST NUMBER LOSES 1 JUDGE'S VOTE.

OOPS! YOU'VE STUTTERED ON THE INTERVIEW. TAKE 1 BAD MARK.

SHAME ON YOU! YOU BELCHED DURING THE INTERVIEW! THANKFULLY ONLY JUDGE #2 HEARD IT. RETURN HIS VOTE.

MYRA IS FLIRTING WITH JUDGE #2. SHE EARNS HIS VOTE.

BONUS CREDIT TAKE 3 VOTES FROM THE TOKEN BOX.

INTERVIEW QUESTION: HER BROTHER DOES THE MOON WALK. NAME ONE OF HER SONGS AND ONE OF HER BROTHER'S SONGS. WORTH 2 VOTES. INCORRECT ANSWERS LOSE 1 VOTE.

INTERVIEW QUESTION: NAME THE CONTESTANT TO YOUR RIGHT'S FAVORITE COLOR. CORRECT ANSWER EARNS 1 VOTE. INCORRECT ANSWER, SHE TAKES YOUR VOTE.

INTERVIEW QUESTION: SPELL THE PERSON TO YOUR LEFT'S LAST NAME. SPELL RIGHT. EARN 1 VOTE. SPELL WRONG—SHE TAKES ONE OF YOURS.

MOVE FORWARD 2 SPACES.

PAULA IS SUCH A FLIRT. SHE KEEPS BATTING HER EYES AT JUDGE #7. SHE WINS HIS VOTE.

INTERVIEW QUESTION: (FOR 3 VOTES) NAME 3 FIRST LADIES' NAMES (ANY) HINT:_____ROOSEVELT_____WASHINGTON_____BUSH

INTERVIEW QUESTION: NAME THE PERSON TO YOUR LEFT'S FAVORITE ANIMAL AND THEIR PET'S NAME. EARN 1 VOTE FOR EACH CORRECT ANSWER. LOSE 1 VOTE FOR WRONG ANSWER.

JUDGE #4 DOESN'T LIKE YOUR ANSWER TO THE INTERVIEW. RETURN HIS VOTE.

PAULA WAS VERY IMPRESSIVE ON HER INTERVIEW. SHE EARNS 3 VOTES.

JUDGE #2 OVERHEARD ONE OF THE GIRLS COMPLAINING ABOUT THE PRIZES FOR THE RUNNERS-UP, SAYING THEY WERE CHEAP. ALL PLAYERS ROLL DIE. LOWEST ROLL IS COMPLAINER—LOSES 3 VOTES.

MOVE BACK 4 SPACES. (IF UNABLE, MOVE FORWARD 1 SPACE.)

MOVE BACK 3 SPACES.

Additional apparatus may be used during certain of the four individual rounds of the game (evening gown round, swimsuit round, talent round and interview round). FIG. 13 depicts a typical swimsuit overlay 60. During setup each contestant chooses a swimsuit overlay 60 to be used with each of that contestant's contestant pieces 4 during the swimsuit round.

FIG. 14 depicts a stack of skill cards 54. During setup each contestant chooses a skill card 54 to be used with each of that contestant's contestant pieces 4 during the talent round. In the preferred embodiment, skill cards 54 included Acrobat, Ballet Dancer, Baton Twirler, Belly Dancer, Comic, Country Dancer, Country Singer, Flute Player, Guitar Player, Jazz Dancer, Jazz Singer, Juggler, Piano Player, Opera Singer, Poetess, Rock & Roll Singer and Tap Dancer.

GAME PLAY

Setup

1. Each player chooses one or more contestant cards 4, either deliberately or randomly. Typically, a player will choose between one and three contestant cards 4. Contestant cards 4 may be stood up vertically in piece bases.

2. Each player chooses a swimsuit overlay 60 and a skill card 54 for each contestant piece 4 controlled by that player.

3. Players pick specific judges by selecting judge name cards 46 and associated judge vote tokens 50. In the alternative, contestants may specify their own judges (current television and movie stars, cute boys in the contestants' classes, etc.) by writing the specified judges' names on blank judge name cards 46.

4. One selected judge name card 46 is placed on each judge name square 34.

5. Judge vote tokens 50 identified with each selected judge are placed on the judge vote token repository 36 adjacent each appropriate judge name square 34.

6. Vote tokens 42 are placed on vote tokens repository 22.

7. Bad mark tokens 44 are placed on bad mark tokens repository 24.

8. Evening gown cards 27, swimsuit cards 29, talent cards 31 and interview cards 33 are shuffled and stacked on evening gown cards repository 26, swimsuit cards repository 28, talent cards repository 30 and interview cards repository 32 respectively.

Play

9. Pageant game 2 begins with each player rolling die 20 to determine the order of play. The highest rolling player moves one of that player's contestant pieces 4 to the start circle 10 marked "1", the second highest rolling player moves one of that player's contestant pieces 4 to the start circle 10 marked "2" and so on until all the contestant pieces 4 are disposed on start circles 10.

10. Evening Gown Round. The first round of pageant game 2 may be the evening gown round.

11. The first player rolls die 20 and advances the contestant piece 4 on the start circle 10 marked "1" the number of tiles 16 indicated on die 20, and follows the instructions embodied in the tile indicia 18 of the tile 16 landed upon. Example: A player rolls a four with die 20. That player advances the contestant piece 4 on the start circle 10 marked "1" four tiles 16 to the fourth tile 16, whose tile indicia 18 reads "THOSE LIGHTS ARE HOT! KEEP ON SMILING! (DRAW)". The player would draw one evening gown card 27 (because the present round is the evening gown round), and follow the instructions on it.

12. The second player rolls die 10 and advances the contestant piece 4 on the start circle 10 marked "2" the number of tiles 16 indicated on die 20, and follows the instructions embodied in the tile indicia 18 of the tile 16 landed upon, and so on.

13. The first contestant piece 4 to arrive at the last tile 16 of game course 15 moves to the start circle 10 marked "1" and waits for all the other contestant pieces 4 to complete the round. The second contestant piece 4 to arrive at the last tile 16 of game course moves to the start circle 10 marked "2" and waits for all the other remaining contestant pieces 4 to complete the round, and so on.

14. No contestant piece 4 may take the votes of, nor disqualify, a contestant piece 4 which is disposed in a tile 16 marked "SAFETY ZONE".

15. A contestant piece 4 earning three bad mark tokens 44 during a given round is disqualified from that round and must move to the last start circle 10, so as to resume play during the next round as the last contestant piece 4 to start.

16. After each contestant piece 4 completes a given round, that contestant piece 4 retains its vote tokens 42 and 50 and bad mark tokens 24—these cannot be used, returned, or traded at any time until accounting following the last round.

17. Swimsuit Round. The second round of pageant game 2 may be the swimsuit round. Swimsuit overlays 60 are placed on all contestant pieces 4, and play proceeds as in the evening gown round, except that the only cards drawn are swimsuit cards 29.

18. Talent Round. The third round of pageant game 2 may be the talent round. Each contestant piece 4 uses the talent specified by the skill card 54 previously chosen. Play proceeds as in the previous rounds, except the only cards drawn are talent cards 31.

19. Interview Round. The fourth and final round of pageant game 2 is the interview round, and play proceeds as in the previous rounds, except the only cards drawn are interview cards 33.

20. Game End and Winners: At the end of the last round, all vote tokens 42 and 50, and bad mark tokens 44, associated with each contestant piece 4, are tallied. For each contestant piece 4, twice the number of bad mark tokens 44 is subtracted from the total number of vote tokens 42 and 50, to yield the game score of that contestant piece 4. The contestant piece 4 with the highest game score wins pageant game 2, does a twirl in the winners circle in game course 15, receives a crown, and chooses a prize from prize cards (a trip to Hawaii, $50.00 in cash, a date with one of the judges, etc.). The second and third place winners receive a prize card specifying prizes, and a date with one of the judges.

While a preferred embodiment of the invention has been illustrated herein, it is to be understood that changes and variations may be made by those skilled in the art without departing from the spirit of the appending claims.

DRAWING ITEM INDEX

| | |
|---|---|
| 2 | pageant game |
| 3 | game board |
| 4 | contestant piece |
| 6 | model |
| 8 | contestant piece indicia |
| 10 | start circle |
| 12 | start circle indicia |
| 15 | game course |
| 16 | tile |
| 18 | tile indicia |
| 20 | die |
| 22 | vote tokens repository |
| 24 | bad mark tokens repository |
| 26 | evening gown cards repository |
| 27 | evening gown card |
| 28 | swimsuit cards repository |
| 29 | swimsuit card |
| 30 | talent cards repository |
| 31 | talent card |
| 32 | interview cards repository |
| 33 | interview card |
| 34 | judge name square |
| 35 | judge name square indicia |
| 36 | judge vote token repository |
| 38 | judge vote token repository indicia |
| 40 | winner position circle |
| 42 | vote token |
| 44 | bad mark token |
| 46 | judge name card |
| 48 | judge name card indicia |
| 50 | judge vote token |
| 52 | judge vote token indicia |
| 54 | skill card |
| 60 | swimsuit overlay |

I claim:

1. A pageant game comprising:

a game board marked with a game course, a plurality of start circles, a plurality of judge name squares, a judge vote token repository associated with each said judge name square, a vote tokens repository, a bad mark tokens repository, and at least one card repository;

a plurality of contestant pieces;

a chance device whereby movement of said contestant pieces on said game course may be determined;

a plurality of vote tokens disposed on said vote tokens repository;

a plurality of bad mark tokens disposed on said bad mark tokens repository;

a judge name card disposed on each said judge name square;

a plurality of judge vote tokens disposed on said judge vote token repositories, and a plurality of cards disposed on said at least one card repository.

2. The pageant game of claim 1 wherein said game course is comprised of a plurality of sequential tiles, a first said tile being marked "START", a last said tile being marked "FINISH", at least one intermediate said tile being marked "SAFETY ZONE", and at least one intermediate said tile being marked "WINNERS CIRCLE".

3. The pageant game of claim 1 wherein said at least one card repository comprises an evening gown cards repository, a swimsuit cards repository, a talent cards repository, and an interview cards repository, and a plurality of evening gown cards are disposed on said evening gown cards repository, a plurality of swimsuit cards are disposed on said swimsuit cards repository, a plurality of talent cards are disposed on said talent cards repository, and a plurality of interview cards are disposed on said interview cards repository.

4. The pageant game of claim 3 wherein said game board further comprises a plurality of winner position circles marked "FIRST PLACE", "SECOND PLACE", "THIRD PLACE", etc.

5. The pageant game of claim 4 wherein said chance device is a die.

6. The pageant game of claim 5 wherein said tiles contain tile indicia comprising instructions to game players, and said cards contain instructions to players.

7. The pageant game of claim 4 wherein said start circles are marked "1", "2", "3", etc.

8. The pageant game of claim 1 wherein each said judge vote token repository associated with each said judge name square contains judge vote tokens identified to the particular judge whose name appears on the judge name card on said associated judge name square.

9. A method of play of a pageant game, said pageant game comprising:

a game board marked with a game course, a plurality of start circles, a plurality of judge name squares, a judge vote token repository associated with each said judge name square, a vote tokens repository, a bad mark tokens repository, and at least one card repository;

a plurality of contestant pieces;

a chance device whereby movement of said contestant pieces on said game course may be determined;

a plurality of vote tokens disposed on said vote tokens repository;

a plurality of bad mark tokens disposed on said bad mark tokens repository;

a judge name card disposed on each said judge name square;

a plurality of judge vote tokens disposed on said judge vote token repositories, and a plurality of cards disposed on said at least one card repository; and said method of play comprises the steps of:

A. Determining the order of play;

B. A first player determining a move with said chance device and moving a contestant piece to the tile indicated by said chance device;

C. Said first player following instructions on said tile indicated, some of said tiles containing instructions including the steps of drawing one said card and following instructions on said card, and collecting vote tokens, judge vote tokens or bad mark tokens;

D. A second and subsequent players determining their moves with said chance device, moving their contestant pieces to the tiles indicated by said chance device, and following instructions on said tiles;

E. After all contestants have completed the game course, tallying vote tokens, judge vote tokens and bad mark tokens for each contestant piece, and for each contestant piece subtracting twice the bad mark token count from the combined vote token and judge vote token count, thus determining a game score for each contestant piece; and F. Declaring a contestant piece having the highest game score winner.

10. The method of claim 9 wherein said at least one card repository comprises an evening gown cards repository, a swimsuit cards repository, a talent cards repository, and an interview cards repository, and a plurality of evening gown cards are disposed on said evening gown cards repository, a plurality of swimsuit cards are disposed on said swimsuit cards repository, a plurality of talent cards are disposed on said talent cards repository, and a plurality of interview cards are disposed on said interview cards repository, and wherein said method of play comprises the further steps of:

G. During an evening gown one round drawing only evening gown cards;

H. During a swimsuit round drawing only swimsuit cards;

I. During a talent round drawing only talent cards;

J. During an interview round drawing only interview cards;

K. At a conclusion of each round, moving each contestant piece to a winner position circle bearing a number corresponding to the rank of each contestant piece; and L. At the conclusion of each round, each contestant piece retaining its vote tokens, judge vote tokens and bad mark tokens, and not using, returning nor trading these until an accounting following the last round; and M. At a conclusion of a final round, tallying vote tokens, judge vote tokens and bad mark tokens for each contestant piece, and for each contestant piece subtracting twice the bad mark token count from the combined vote token and judge vote token count, thus determining a game score for each contestant piece, and declaring a contestant piece having the highest game score winner.

11. The method of play of claim 10 including the further steps of:

N. Denying players the ability to remove vote tokens or judge vote tokens from any contestant piece disposed on a tile marked "SAFETY ZONE"; and O. Disqualifying for a given round any contestant piece earning three bad mark tokens during said given round.

12. The method of claim 11 wherein said pageant game further comprises swimsuit overlays and skill cards, and wherein said method of play comprises the following steps:

P. During setup, choosing one said swimsuit overlay and one said skill card for each said contestant piece for use during said swimsuit round and said talent round respectively;

Q. Prior to commencing said swimsuit round, placing one said chosen swimsuit overlay over each said contestant piece; and R. During said talent round, using one said skill card to identify a talent associated with each said contestant piece.

* * * * *